US006308337B1

(12) United States Patent
Penley

(10) Patent No.: US 6,308,337 B1
(45) Date of Patent: Oct. 30, 2001

(54) BLISTER PROTECTION MOHAIR SOCK

(75) Inventor: Regina T. Penley, Hickory, NC (US)

(73) Assignee: Neuville Industries, Inc., Hildebran, NC (US)

( * ) Notice: Subject to any disclaimer, the term of this patent is extended or adjusted under 35 U.S.C. 154(b) by 0 days.

(21) Appl. No.: 09/804,317

(22) Filed: Mar. 12, 2001

(51) Int. Cl.[7] ..... A43B 17/00
(52) U.S. Cl. ..... 2/239
(58) Field of Search ..... 2/239, 272, DIG. 1, 2/409; 66/178

(56) References Cited

U.S. PATENT DOCUMENTS 3,793,851 * 2/1974 Thorneburg ..... 66/185
4,631,755 * 12/1986 Zingg et al. ..... 2/239
5,724,836 * 3/1998 Green ..... 66/185
5,778,702 * 7/1998 Wrightenberry ..... 66/178
5,829,057 * 11/1998 Gunn ..... 2/69
6,032,295 * 3/2000 Marshall ..... 2/239
6,082,146 * 7/2000 Dahlgren ..... 66/185
6,108,820 * 8/2000 Bernhardt ..... 2/239
6,143,368 * 11/2000 Gunn ..... 427/407.1

* cited by examiner

*Primary Examiner*—John J. Calvert
*Assistant Examiner*—Alissa L. Hoey
(74) *Attorney, Agent, or Firm*—Kilpatrick Stockton LLP

(57) ABSTRACT

A sock for managing moisture and reducing friction includes a blend of natural mohair wool fibers and acrylic fibers. Hydrophobic mohair wool wicks moisture away, from the foot of a wearer, and hydrophilic acrylic yarn absorbs moisture wicked from the foot by mohair yarn and holds the moisture away from the skin. As a result, undesirable friction-promoting effects of moisture on a foot are decreased. Mohair wool yarn is disposed on the inner surface of a sock for contact with skin, while acrylic yarn is disposed on the outer surface of the sock away from the skin. A blend of mohair wool and acrylic is placed in areas of a sock likely to have the greatest moisture build-up and the most friction of a foot against the sock and shoe.

24 Claims, 2 Drawing Sheets

BLISTER PROTECTION MOHAIR SOCK

FIELD OF THE INVENTION

The present invention relates to an article of apparel for the foot. In particular, the present invention relates to a sock that decreases moisture and friction between a wearer's foot and a shoe.

BACKGROUND OF THE INVENTION

The pressure of standing and walking in shoes creates friction between a wearer's feet and shoes. Moisture accumulation inside shoes increases shoe-skin friction and the likelihood of blistering. Thus, discomfort and even skin breakdown may be caused by a natural build-up of moisture and the interaction of moisture with movement of a person's feet inside shoes.

In general, foot coverings designed to decrease moisture and associated friction between a wearer's foot and a shoe have been constructed with various combinations and arrangements of both hydrophobic (water-repelling) and hydrophilic (water-absorbing) yarns. An objective of such configurations of hydrophobic and hydrophilic yarns is to provide fabrics with a relatively low moisture regain, or ability to absorb moisture, particularly on a sock surface adjacent to skin. Moisture regain is defined as the moisture present in textile material expressed as a percentage of the moisture-free weight of the material. (Phyllis G. Tortora & Robert S. Merkel, Fairchild's Dictionary of Textiles, 7th Edition, page 465.) A low moisture regain indicates that a fabric, and yarn from which it is made, has a relatively low moisture content. A fabric with a relatively low moisture regain, and thus less retained moisture content, would provide more comfort to a wearer than a fabric with a relatively high moisture regain.

In some arrangements, hydrophilic yarn is placed in high-moisture areas of a foot to absorb moisture. For example, U. S. Pat. No. 4,898,007 to Dahlgren disclose placing hydrophilic yarn, such as cotton or wool, in the toe, heel, and ball areas of al sock and hydrophobic yarn, such as a nylon/acrylic blend, in the sole and instep areas. Such placement is based on the premise that moisture is absorbed by hydrophilic yarn in the toe, heel, and ball areas and is then transferred by wicking action into the hydrophobic yarn away from pressure points and into the middle portion of the foot. In other arrangements, rather than limiting placement of hydrophilic yarn to particular regions of a foot, hydrophilic yarn is placed on the inside of a fabric for direct contact with the skin of most, or all, of a foot. These constructions, however, have the disadvantage of placing high moisture regain, hydrophilic yarns in constant contact with the skin of a foot. Accordingly, sock constructions in which hydrophilic yarn is in contact with skin are more likely to keep the skin moist and create greater susceptibility to friction and blisters.

In contrast, other approaches to moisture management include placement of moisture-repelling hydrophobic yarn in particular regions of a sock, such as areas in contact with high moisture areas of a foot. As an example, U.S. Pat. No. 5,095,548 to Chesebro discloses placing hydrophobic yarn, such as an olefin yarn, in the sole portion of a sock while hydrophilic yarn, such as a blend of cotton and acrylic, is placed in the instep area above the sole. In this arrangement, moisture generated by the foot of the wearer is wicked by the hydrophobic yarn from one part of the foot (the sole) and transported to another part of the foot (the hydrophilic instep) to be evaporated therefrom.

Moisture management socks have also been knit with hydrophobic and hydrophilic yarns in combinations with body yarn. For example, in the Chesebro patent mentioned above, a body yarn, such as nylon, is knit in successive courses throughout the sock. Hydrophobic yarn is knit in plated relationship with the body yarn in partial courses extending throughout the sole, and hydrophilic yarn is knit in plated relationship with the body yarn in partial courses extending throughout the instep. While use of body yarn allows non-contiguous placement of hydrophobic and hydrophilic yarns, body yarn disadvantageously increases the bulk of resulting socks.

Combinations of hydrophobic yarn and hydrophilic yarn have also been used in socks having multiple layers. U.S. Pat. No. 4,615,188 to Hursh et al. discloses such a multi-layered sock, the first ply inner layer having a surface adapted to contact the skin and formed principally of low moisture regain hydrophobic yarns, such as polypropylene and polypropylene/wool combinations. In this design the hydrophobic yarns have undesirable high frictional characteristics in order to grip the skin so that inter-layer surfaces may slide against each other. Multi-ply socks are disadvantageous in that they are bulky and tend to bunch up, thereby causing abrasion, blisters, and discomfort.

Socks designed to enhance the movement of moisture away from a wearer's foot have also been used in conjunction with a particular shoe construction, for example, shoes designed to vent moisture absorbed by the sock away from a foot. Usefulness of these types of moisture management socks is limited due to the need to use such socks with a specially designed shoe.

In yet other sock constructions, moisture management is provided by plating hydrophobic yarn on the inside of a sock for contact with a wearer's foot, while hydrophilic yarn is plated on the outside of the sock. In such an arrangement, moisture generated by the foot of a wearer is wicked and transported by the hydrophobic yarn outwardly away from the foot, where it is absorbed by the hydrophilic yarn on the outside of the sock, and held away from the foot and/or evaporated from the sock. An example of this type of construction is given in U.S. Pat. No. 3,250,095 to Bird, which discloses hydrophobic yarn including synthetic yarns such as acrylic, and hydrophilic yarn as cotton, rayon, wool, silk, or combinations thereof.

Previous approaches to managing moisture via sock construction have had varied success. Thus, there is a need to provide an improved sock construction that can effectively manage moisture build-up on the foot of a wearer and decrease friction and the likelihood of blisters.

It has been found that mohair wool, a naturally moisture-wicking fiber, effectively manages moisture in a sock and decreases the friction-promoting effects of moisture on a foot. In addition, mohair wool is a slick fiber that allows a foot to move inside a sock with less friction and protects against blisters by cushioning the foot. Prior sock constructions designed to provide moisture management have not utilized mohair wool as a hydrophobic yarn placed on the inside surface of a sock for contact with a wearer's skin blended with a hydrophilic yarn on the outer sock surface. As such, the advantages of a mohair wool/hydrophilic yarn blend have not been used to improve moisture management in a sock that overcome the disadvantages of other sock constructions.

Thus, there is a need for a sock having improved moisture management utilizing low moisture regain mohair wool yarn on the inside surface of a sock in a single layer that provides a high quality hand and enhanced comfort. In addition, there is a need for providing an improved moisture management sock construction using mohair wool that can be easily and economically manufactured and used. It is to these perceived needs that the present invention is directed.

SUMMARY OF THE INVENTION

The present invention provides an article of apparel for a foot that effectively manages moisture and reduces friction. In an embodiment of the present invention, a moisture management sock comprises a blend of natural mohair fibers and acrylic fibers. Mohair wool is naturally hydrophobic and wicks moisture away from a source of moisture. As such, mohair wool is characterized by low moisture regain. When mohair wool is placed in a sock so that the mohair wool comes into contact with the skin of a wearer, as in the present invention, moisture is wicked away from a foot and thereby decreases undesirable friction-promoting effects of moisture on the foot.

In embodiments of the present invention, a blend of mohair wool and acrylic is placed in areas of a sock corresponding to areas of a foot likely to have the greatest moisture build-up, and the most movement and pressure of the foot against the sock and shoe. For example, embodiments include a mohair wool/acrylic blend placed in high moisture and friction areas that are more prone to develop blisters, such as the heel, toe, and/or sole areas. In another embodiment, a mohair wool/acrylic blend is placed in the toe cap portion of the toe area of a sock. Such a blend and placement of fibers in a sock allows moisture to be wicked away from affected areas of a foot, reducing friction and enhancing comfort.

In preferred embodiments, a sock of the present invention comprises at least 50% mohair wool. More preferably, embodiments of a sock of the present invention comprise a blend of 65% natural mohair wool and 35% acrylic.

In embodiments of the present invention, mohair wool yarn and acrylic yarn arm oriented relative to each other and to the skin of a wearer's foot so as to optimize moisture management and reduce friction. For example, hydrophobic mohair wool yarn is disposed on the inner surface of the sock for contact with the skin of a wearer. In this arrangement, moisture is wicked away from the wearer's foot by the mohair wool. In conjunction with moisture-wicking mohair wool placed on the inner surface of a sock, hydrophilic acrylic yarn is disposed on the outer surface of the sock away from the skin of the wearer. In this relative relationship of hydrophobic and hydrophilic yarns, acrylic yarn receives moisture wicked from the foot by the mohair yarn and holds the moisture away from the skin. Thus, the friction-promoting effects of moisture on a foot are reduced.

In addition to reducing moisture, mohair wool provides further friction-reducing and comfort-enhancing qualities in socks of the present invention. Mohair wool fibers have a slick surface and thus a low coefficient of resistance to movement, such as by a foot. Moreover, mohair wool exhibits a naturally soft texture and compressibility that provides cushioning to a foot. Therefore, a sock made with natural mohair fibers as in the present invention provides enhanced cushioning and protection against blisters by allowing a foot to move inside a sock with less friction.

A mohair-containing sock as in the present invention may be knit with a flat knit construction. In other embodiments, a mohair-containing sock as in the present invention is knit with a terry knit construction, which provides additional cushioning. Preferably, a sock knit with terry knit construction has terry loops disposed on the inner surface of the sock. Terry loops disposed on the inner surface of a sock as in the present invention provide greater sock surface area in contact with the skin of a foot such that moisture is more readily wicked away from the foot.

Embodiments of the present invention include mohair-containing socks, comprising various sizes and lengths. For example, socks of the present invention may be made in ankle-high, above-ankle, and mid-calf lengths.

Moisture management socks including mohair wool as in the present invention may be constructed using conventional sock manufacturing equipment, methods, and techniques. Mohair-containing socks as in the present invention can be manufactured and supplied to customers at significantly less cost than socks made with other friction-reducing materials. For example, moisture-wicking socks containing Teflon® cost consumers in the range of $15–20 per pair, whereas mohair-containing socks as in the present invention cost consumers approximately three to four dollars per pair.

Features of a moisture management sock of the present invention may be accomplished in one or more of the embodiments of the present invention. As will be appreciated by those of ordinary skill in the art, the present invention has wide utility in a number of applications as illustrated by the variety of features and advantages discussed below.

A moisture management sock of the present invention provides numerous advantages over prior sock materials and constructions. For example, the present: invention advantageously provides a blend of mohair wool and acrylic in a sock that effectively manages moisture and reduces friction. In particular, a blend of 65% mohair wool and 35% acrylic in a sock of the present invention provides the advantage of improved wicking of moisture away from a wearer's foot by the mohair wool and absorption of the moisture by the acrylic fibers, whereby friction associated with movement of the wearer's foot is decreased.

Another advantage is that the present invention provides a blend of mohair wool and acrylic placed in areas of a sock corresponding to areas of a foot that are more prone to develop blisters. As a result of placing a mohair wool/acrylic blend in areas likely to have the greatest moisture build-up and the most movement and pressure of the foot against the sock and shoe, such as in the heel, toe, sole, and/or toe cap areas, removal of moisture from affected areas is improved, friction is reduced, and the likelihood of blisters is decreased.

Another advantage of the present invention is that hydrophobic mohair wool yarn is disposed on the inner surface of a sock for contact with the skin of a wearer and hydrophilic acrylic yarn is disposed on the outer surface of the sock away from the skin of the wearer. This configuration of yarns provides the improvement and advantage of acrylic yarn receiving moisture wicked from the foot by the mohair yarn and holding the moisture away from the skin. Thus, such embodiments of the present invention reduce the friction-promoting effects of moisture on a foot.

Another advantage is that the present invention provides a blend of mohair wool and acrylic that improves moisture management and reduces friction that can be flat knit and/or terry knit. Embodiments of the present invention having terry knit construction provide the benefit of additional cushioning to a sock. In addition, socks of the present invention having terry loops disposed on the inner surface advantageously provide greater sock surface area in contact with the skin of a foot such that moisture is more readily wicked away from the foot.

Yet another advantage of a blend of mohair wool and acrylic that improves moisture management in socks as in the present invention is a desirable hand due to the natural softness of mohair wool, which increase cushioning and comfort. Additionally, the present invention provides the benefit of increased warmth due to the natural insulating effects of mohair wool.

Still another advantage is that the present invention provides socks having improved moisture management and friction reduction that overcome the disadvantages of increased bulk due to use of body yarns in prior sock constructions. Socks of the present invention also provide improved moisture management and friction reduction while overcoming the disadvantages of bulky construction and friction promotion due to bunching in prior socks having multiple layers.

Still another advantage is that mohair/acrylic blend socks of the present invention having the above-described advantages can be easily and economically made using conventional manufacturing equipment, methods, and techniques. The present invention provides the advantages of socks having improved moisture management and friction reduction, that reduce the risk of blisters and improve comfort, and that are also affordable to consumers.

As will be realized by those of skill in the art, many different embodiments of a moisture management sock containing mohair wool according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

The present invention provides an article of apparel for a foot that effectively manages moisture and reduces friction. In embodiments of the present invention, a moisture management sock comprises a blend of natural mohair fibers and acrylic fibers. Mohair is a long, white, lustrous hair obtained from the angora goat. When spun into fabric, its pile will stand erect and is durable and resistant. (P. G. Tortora & R. S. Merkel, Fairchild's Dictionary of Textiles, 7th Edition, page 364.) Typical of animal fibers in general, mohair wool has a slick surface and protects against friction. In addition, mohair wool is naturally hydrophobic, and thus wicks moisture away from a source of moisture and exhibits low moisture regain. South African mohair wool from a young (kid) goat has been found to be particularly effective in wicking moisture in embodiments of the present invention. Therefore, when mohair wool is placed in a sock so that the mohair wool comes into contact with the skin of a wearer, as in the present invention, moisture is wicked away from a foot and the friction-promoting effects of moisture on the foot are decreased.

Figure 1:
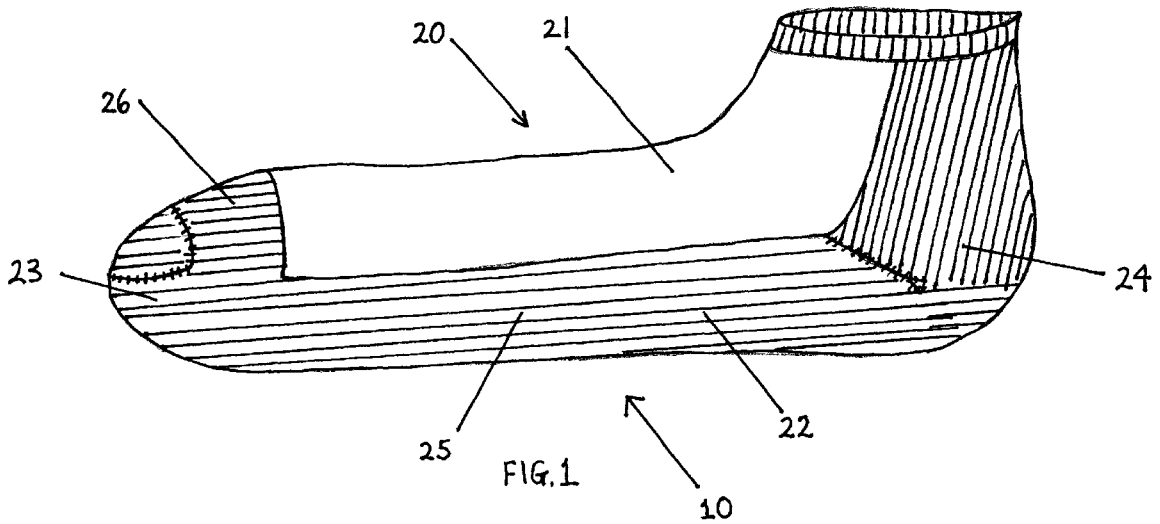
FIG. 1 is a view of an ankle-high sock in an embodiment of the present invention.

An illustrative example of an embodiment of the present invention is shown in FIG. 1. A sock 10 for managing moisture and friction on a wearer's foot includes a foot portion 20 having a top 21 and a bottom 22. The sock foot 20 comprises a toe portion 23, a heel portion 24, and a sole portion 25 extending between the toe 23 and heel 24 and around the bottom 22 of the sock. In an embodiment, the sole portion 25 16 comprises approximately the bottom half of a sock foot 20, as shown in FIG. 1. The toe, heel, and sole portions, 23, 24, and 25, respectively, of the sock foot 20 are knit with mohair wool and acrylic fibers. When the sock 10 is worn, moisture is wicked away from the wearer's foot by the mohair wool and is absorbed by the hydrophilic acrylic fibers, whereby friction associated with movement of the wearers foot is decreased.

In an embodiment, as illustrated in FIG. 1, toe portion 23 of sock 10 comprises a toe cap 26. The toe, heel, and sole portions, 23, 24, and 25, respectively, and toe cap 26 of the sock foot 20 are knit with mohair wool and acrylic fibers. When the sock 10 is worn, moisture is wicked away from each of the toe, heel, sole, and toe cap areas of the wearer's foot by the mohair wool and is absorbed by the hydrophilic acrylic fibers, such that friction associated with movement of the wearer's foot is decreased in each of these areas. By placing a blend of mohair wool and acrylic in areas of sock foot 20 corresponding to areas of a foot likely to have the greatest moisture build-up and increased friction (such as in the toe, heel, sole, and toe cap), moisture and friction are effectively reduced in areas that are more prone to develop blisters.

In embodiments of the present invention, such as in FIG. 1, toe 23, heel 24, sole 25, and toe cap 26 of sock foot 20 comprise at least 50% mohair wool. In preferred embodiments, toe 23, heel 24, sole 25, and toe cap 26 comprise a blend of 65% mohair wool and 35% acrylic.

Figure 2:
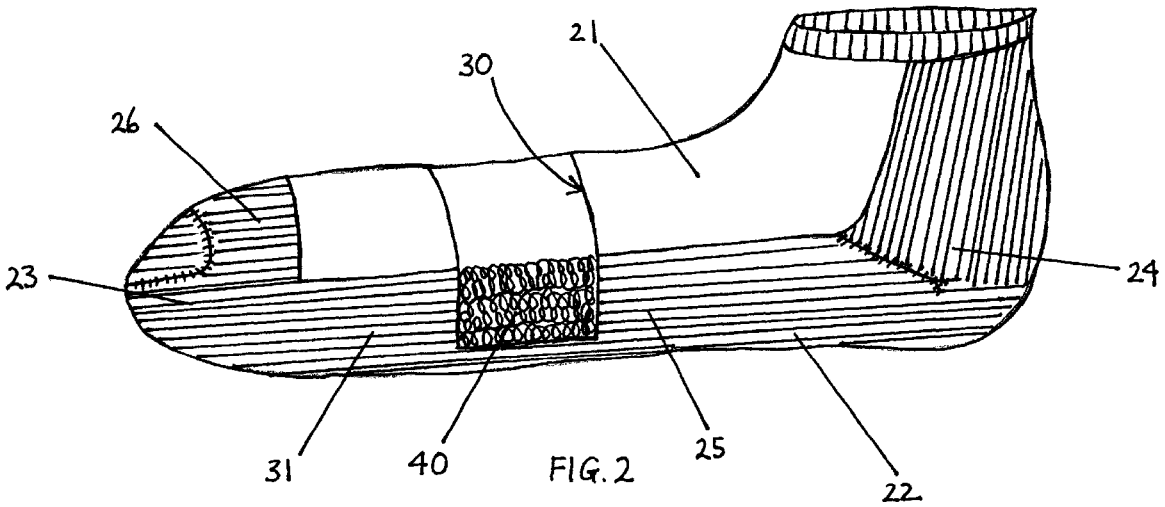
FIG. 2 is a view of the ankle-high sock of FIG. 1 with a partial cut-away section showing an inner surface of the sock in an embodiment of the present invention.

In embodiments of the present invention, mohair wool yarn and acrylic yarn are oriented relative to each other and to the skin of a wearer's foot so as to optimize moisture management and reduce friction. For example, as seen in FIG. 2, hydrophobic mohair wool yarn is disposed on the inner surface 30 of toe 23, heel 24, sole 25, and toe cap 26 of sock foot 20 for contact with the skin of a wearer. In conjunction with moisture-wicking mohair wool placed on inner surface 30, hydrophilic acrylic yarn is disposed on outer surface 40 of toe 23, heel 24, sole 25, and toe cap 26 of sock foot 20, away from the skin of the wearer. In this configuration, acrylic yarn receives moisture wicked from the foot by the mohair yarn and holds the moisture away from the skin. As a result, the friction-promoting effects of moisture on a foot are reduced.

Figure 3:
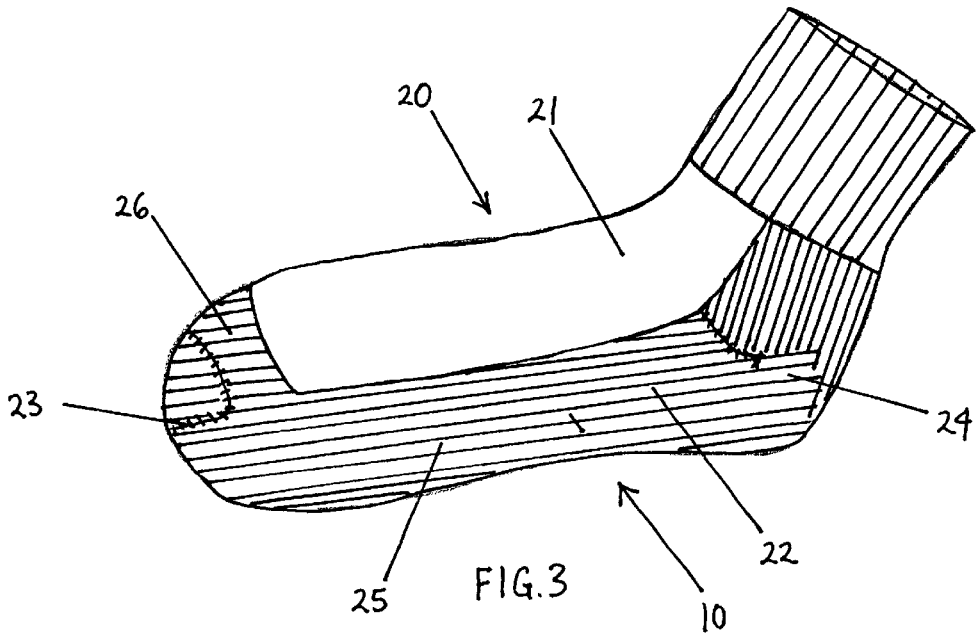
FIG. 3 is a view of an above-ankle sock in an embodiment of the present invention.
Figure 4:
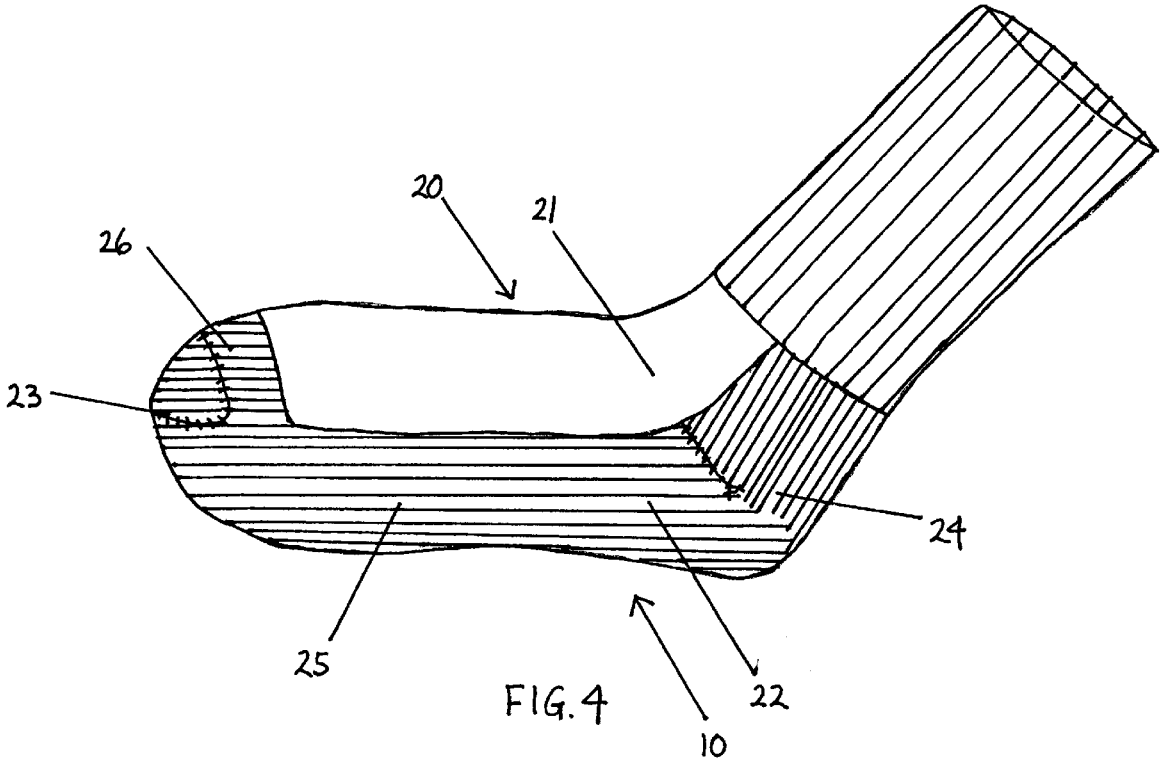
FIG. 4 is a view of a mid-calf sock in an embodiment of the present invention.

FIGS. 1 and 2 depict an ankle-high embodiment of a sock of the present invention. Moisture management socks comprising a blend of natural mohair fibers and acrylic fibers as in the present invention can be provided in various sizes. For example, FIG. 3 shows an above-ankle sock in an embodiment of the present invention. FIG. 4 shows a mid-calf sock in an embodiment of the present invention. Embodiments of various sizes, for example, as shown in FIGS. 3 and 4, include the same mohair and acrylic blends, placed in the same toe 23, heel 24, sole 25, and toe cap 26 areas, and have the same arrangement of mohair relative to acrylic as described for embodiments shown in FIGS. 1 and 2 above.

A mohair-containing sock as in the present invention may be knit with a flat knit construction. In other embodiments, a mohair-containing sock of the present invention is knit with a terry knit construction, as seen in FIG. 2. Preferably, a sock knit with terry knit construction has terry loops 40 disposed on inner surface 30 of the sock foot 20. Terry loops 40 disposed on inner surface 30 of a sock as in the present invention provide greater sock surface area in contact with the skin of a foot such that moisture is more readily wicked away from the foot. Terry knit construction also provides additional cushioning.

In embodiments of the present invention, moisture management socks including mohair wool may be constructed using conventional sock manufacturing equipment, methods, and techniques. Therefore, moisture management socks of the present invention can be easily and economically made.

Socks of the present invention are constructed with minimal use of seams so as to minimize friction points between a foot, sock, and shoe. Moreover, socks of the present invention provide seamless construction in areas of greatest pressure on the bottom of a foot against a sock and shoe to reduce friction and enhance comfort.

In addition, mohair wool socks of the present invention are scoured in a finishing bath to remove knitting oils and are not otherwise treated with chemicals. As a result, socks of the present invention maintain the soft hand, slick surface, and cushion qualities of natural mohair fibers. Thus, mohair-containing socks of the present invention effectively managing moisture, reduce friction, and provide enhanced comfort.

Although the present invention has been described with reference to particular embodiments, it should be recognized that these embodiments are merely illustrative of the principles of the present invention. Those of ordinary skill in the art will appreciate that a moisture management sock including mohair wool of the present invention may be constructed and implemented in other ways and embodiments. Accordingly, the description herein should not be read as limiting the present invention, as other embodiments also fall within the scope of the present invention.

What is claimed is:

1. A sock for managing moisture and friction on a wearer's foot, the sock including a foot portion having a top and a bottom, the sock foot comprising:

a toe portion, a heel portion, and a sole portion extending between the toe and heel portions and around the bottom of the sock; and the toe, heel, and sole portions knit with mohair wool and acrylic fibers;

wherein, when the sock is worm, moisture is wicked away from the wearer's foot by the mohair wool and is absorbed by the acrylic fibers, whereby friction associated with movement of the wearer's foot is decreased.

2. The sock of claim 1, wherein the toe, heel, and sole portions comprise at least 50% mohair wool.

3. The sock of claim 2, wherein the toe, heel, and sole portions comprise 65% mohair wool and 35% acrylic.

4. The sock of claim 3, the sock further comprising an inner surface and an outer surface, wherein the mohair fibers are disposed on the inner surface and the acrylic fibers are disposed on the outer surface of the toe, heel, and sole portions of the sock.

5. The sock of claim 4, wherein the toe, heel, and sole portions are flat knit.

6. The sock of claim 4, wherein the inner surface of the toe, heel, and sole portions is terry knit.

7. The sock of claim 5, wherein the sock is an ankle-high sock.

8. The sock of claim 5, wherein the sock is an above-ankle sock.

9. The sock of claim 5, wherein the sock is a mid-calf sock.

10. The sock of claim 6, wherein the sock is an ankle-high sock.

11. The sock of claim 6, wherein the sock is an above-ankle sock.

12. The sock of claim 6, wherein the sock is a mid-calf sock.

13. A sock for managing moisture and friction on a wearer's foot, the sock including a foot portion having a top and a bottom, the sock foot comprising:

a toe portion, a heel portion, and a sole portion extending between the toe and heel portions and around the bottom of the sock, the toe portion further comprising a toe cap; and the toe, heel, and sole portions and the toe cap knit with mohair wool and acrylic fibers;

wherein, when the sock is worm, moisture is wicked away from the wearer's foot: by the mohair wool and is absorbed by the acrylic fibers, whereby friction associated with movement of the wearer's foot is decreased.

14. The sock of claim 13, wherein the toe, heel, and sole portions and the toe cap comprise at least 50% mohair wool.

15. The sock of claim 14, wherein the toe, heel, and sole portions and the toe cap comprise 65% mohair wool and 35% acrylic.

16. The sock of claim 15, the sock further comprising an inner surface and an outer surface, wherein the mohair fibers are disposed on the inner surface and acrylic fibers are disposed on the outer surface of the sock.

17. The sock of claim 16, wherein the toe, heel, and sole portions and the toe cap are flat knit.

18. The sock of claim 16, wherein the inner surface of the toe, heel, and sole portions and the inner surface of the toe cap are terry knit.

19. The sock of claim 17, wherein the sock is an ankle-high sock.

20. The sock of claim 17, wherein the sock is an above-ankle sock.

21. The sock of claim 17, wherein the sock is a mid-calf sock.

22. The sock of claim 18, wherein the sock is an ankle-high sock.

23. The sock of claim 18, wherein the sock is an above-ankle sock.

24. The sock of claim 18, wherein the sock is a mid-calf sock.

* * * * *

UNITED STATES PATENT AND TRADEMARK OFFICE

CERTIFICATE OF CORRECTION

PATENT NO. : 6,308,337 B1
DATED : October 30, 2001
INVENTOR(S) : Regina T. Penely It is certified that error appears in the above-identified patent and that said Letters Patent is hereby corrected as shown below:

Title page,
Item [56], References Cited, under U.S. PATENT DOCUMENTS, please add the following:

| | | | |
|---|---|---|---|
| -- 3,250,095 | 5/1966 | Bird | 66/178 |
| 3,796,067 | 3/1974 | East | 66/178 |
| 4,571,960 | 2/1986 | Hursh et al. | 66/196 |
| 4,615,188 | 10/1986 | Hursh et al. | 66/196 |
| 4,898,007 | 2/1990 | Dahlgren | 66/185 |
| 5,095,548 | 3/1992 | Chesebro, Jr. | 2/239 |
| 5,319,807 | 6/1994 | Brier | 2/239 |
| 5,735,145 | 4/1998 | Pernick | 66/196 |
| 5,849,648 | 12/1998 | Kent et al. | 442/414 |
| 5,937,542 | 8/1999 | Bourdeau | 36/10 -- |

Column 1,
Line 40, delete “al” and replace with -- a --.

Column 3,
Line 39, delete “arm” and replace with -- are --.

Column 4,
Line 7, delete the comma “,” after “socks.”
Line 29, delete the colon “:” after “present.”

Column 6,
Line 8, delete the number “16” after the number “25.”
Line 15, delete “wearers” and replace with -- wearer’s --.

Column 7,
Line 26, delete “aging” and replace with -- age --.
Line 48, delete “worm” and replace with -- worn --.

UNITED STATES PATENT AND TRADEMARK OFFICE

CERTIFICATE OF CORRECTION

PATENT NO. : 6,308,337 B1
DATED : October 30, 2001
INVENTOR(S) : Regina T. Penely It is certified that error appears in the above-identified patent and that said Letters Patent is hereby corrected as shown below:

Column 8,
Line 27, delete “worm” and replace with -- worn --.
Line 28, delete the colon “:” after “foot”.

Signed and Sealed this

Twenty-fifth Day of June, 2002

*Attest:*

*Attesting Officer*

JAMES E. ROGAN
*Director of the United States Patent and Trademark Office*